US006261107B1

(12) United States Patent
Takase et al.

(10) Patent No.: US 6,261,107 B1
(45) Date of Patent: Jul. 17, 2001

(54) SURFACE MOUNT CONNECTOR HAVING IMPROVED TERMINAL STRUCTURE

(75) Inventors: Hisato Takase, Machida; Yoshikazu Ito, Yamato; Hiroshi Ikesugi, Yokohama; Masanori Yagi, Ebina, all of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/381,188

(22) PCT Filed: Jan. 15, 1999

(86) PCT No.: PCT/US99/01027

§ 371 Date: Sep. 16, 1999

§ 102(e) Date: Sep. 16, 1999

(87) PCT Pub. No.: WO99/36994

PCT Pub. Date: Jul. 22, 1999

(30) Foreign Application Priority Data

Jan. 16, 1998 (JP) ..... 10-020459

(51) Int. Cl.[7] ..... H01R 12/00

(52) U.S. Cl. ..... 439/79; 439/636; 439/660; 439/862; 439/941

(58) Field of Search ..... 439/79, 660, 636, 439/862, 941

(56) References Cited

U.S. PATENT DOCUMENTS 4,795,379 * 1/1989 Sasaki et al. ..... 439/856
5,238,412 8/1993 Morishita et al. .
5,516,297 5/1996 Atoh et al. .
5,636,999 6/1997 Hirai et al. .
5,645,436 7/1997 Shimizu et al. .
5,688,130 11/1997 Huang .
5,775,923 7/1998 Tomioka .

FOREIGN PATENT DOCUMENTS 0569893 5/1993 (EP) .
9936995 7/1999 (WO) .
9937000 7/1999 (WO) .

* cited by examiner

*Primary Examiner*—Paula Bradley
*Assistant Examiner*—Truc Nguyen
(74) *Attorney, Agent, or Firm*—Charles S. Cohen; Thomas D. Paulius

(57) ABSTRACT

A surface mount connector is disclosed having an improved terminal construction that avoid shorting between adjacent terminal contact portions, while maintaining a multi-pole structure with a reduced pitch of the terminal solder tail portions. The connector has an insulative connector housing with a plurality of terminals loaded in the housing on opposite sides of an opposing connector engaging slot. The terminals have contact that face into the slot and which are arranged in parallel in a predetermined pitch. Solder tail portions of the terminals extend underneath portions of the terminals and are arranged in parallel in a pitch that is one-half that of the pitch of the terminal contact portions.

7 Claims, 5 Drawing Sheets

SURFACE MOUNT CONNECTOR HAVING IMPROVED TERMINAL STRUCTURE

BACK OF THE INVENTION

The present invention relates generally to surface mount connectors mounted by soldering, to printed circuit boards, and more particularly to a surface mount connector having a terminal structure with an improved pitch arrangement of the connector solder tails.

Conventional surface mount connectors use insulative housing with a plurality of terminals. The terminals have contact portions on ends thereof that line a slot formed in the connector housing. Solder tail portions are formed on the other ends of the terminals and extend on both sides of the connector housing. The solder tail portions are arranged substantially flush with the bottom surface of the connector housing so as to contact conductive pads on the circuit board. In these connectors, increasing the number of contact portions of the terminals causes a corresponding reduction in the pitch of the solder tails and of the contact portions of the terminals. This occurs when the overall size of the connector is reduced.

In this conventional connector, reducing the pitch of the solder tails requires that the pitch of the terminal contact portion also be reduced. In order to reduce the pitch between the terminals, the clearances between adjacent terminal contact portions are also reduced. Reducing these clearances increases possibility of causing of causing shorting between the adjacent terminal contact portions when the surface mount connector is mated with a counterpart opposing connector, which possibly degrades the security of the connection obtained between the two connectors.

SUMMARY OF THE INVENTION

The present invention is directed to a surface mount connector that overcomes the aforementioned disadvantages.

Therefore, it is a general object of the present invention to provide a surface mount connector which avoids shorting between adjacent terminal contact portions, but while maintaining a high-density terminal arrangement with a decreased pitch of the solder tails.

Another object of the present invention is to provide a surface mount connector wherein the pitch of the terminal solder tail portions is decreased while the number of terminal contact portions is increased and wherein the terminal contact portions are provided at a greater pitch than that of the solder tail portions.

In order to accomplish the above objects and in accordance with a principal aspect of the present invention, a surface mount connector is provided having an insulative connector housing and a plurality of terminals disposed in the connector housing, the terminals having contact portions formed along one set of ends thereof, the contact portions being arranged in parallel along a slot formed in the connector housing in a predetermined pitch. The terminals of each solder tail portion extend out of the connector housing along only one side of the connector, but in a parallel arrangement having a pitch equal to one-half the pitch of the contact portions. The solder tail portions extend substantially flush along a bottom surface of the connector housing and extend outwardly therefrom.

In accordance with another principal aspect of the present invention, a surface mount connector is provided that includes an elongated connector housing formed from an electrically insulative material and a plurality of conductive terminals loaded in the connector housing on opposite sides of an opposing connector-receiving passage, the terminals including contact portions that face inwardly of an opposing connector engaging slot formed in the connector housing. The terminals also include solder tail portions for attaching the connector to the surface of a printed circuit board by way of soldering, the solder tail portions extending outwardly from the connector housing along a bottom surface thereof.

The terminals in the connector are arranged so that the contact portions of each pair of terminals lie in opposing alignment with each other. The terminals are configured such that the solder tails of one of the terminals in a chosen pair of opposing terminals extending out of the connector housing along a bottom surface thereof, while the solder tails of the other terminal in the chosen pair of terminals extend under the one terminals, with both of the two solder tail portion arranged in a parallel relationship. In this manner the solder tails of the terminals on both sides of the passage, but extend out of the connector on only one side of the connector. The contact portions of the terminals are arranged in a predetermined pitch, and the solder tail portions are arranged in a pitch that is one-half of the predetermined pitch.

In a preferred embodiment, the connector housing may be formed as a receptacle connector housing having two parallel slots, or receptacles that engage portions of an opposing connector. The terminal contact portions of the two rows of terminals line opposite sides of each slot. The solder tail portions of the terminals lining the sides of one of the two slots extend outwardly along only one side of the connector housing, while the solder tail portions of the terminals lining the sides of the other of the two slots extend outwardly along the other side of the connector housing.

In this manner, the terminal contact portions are provided with a predetermined pitch that is twice the pitch of the terminal solder tail portions. With such a structure, the pitch between the adjacent terminal contact portions is relatively wide, and shorting between adjacent terminal contact portions can be successfully avoided in order to ensure a secure electrical connection between the connector and an opposing connector. Likewise, the pitch between adjacent solder tail portions may be made relatively narrower, thereby increasing the density for connecting of circuits on a printed circuit board. The solder tail portions extended outwardly from the bottom surface of the connector housing, and thus inspection of the soldering of the solder tail portions to the circuit board contact pads may be performed without interference of the connector housing.

These and other objects, features and advantages of the present invention will become apparent from the following detailed description, taken in conjunction with the accompanying drawings.

BRIEF DESCRIPTION OF THE DRAWINGS

In the course of the following description of the detailed description, reference will be made to the attached drawings wherein like reference numerals identify like parts and wherein.

DETAILED DESCRIPTION OF THE PREFERRED EMBODIMENTS

Figure 1:
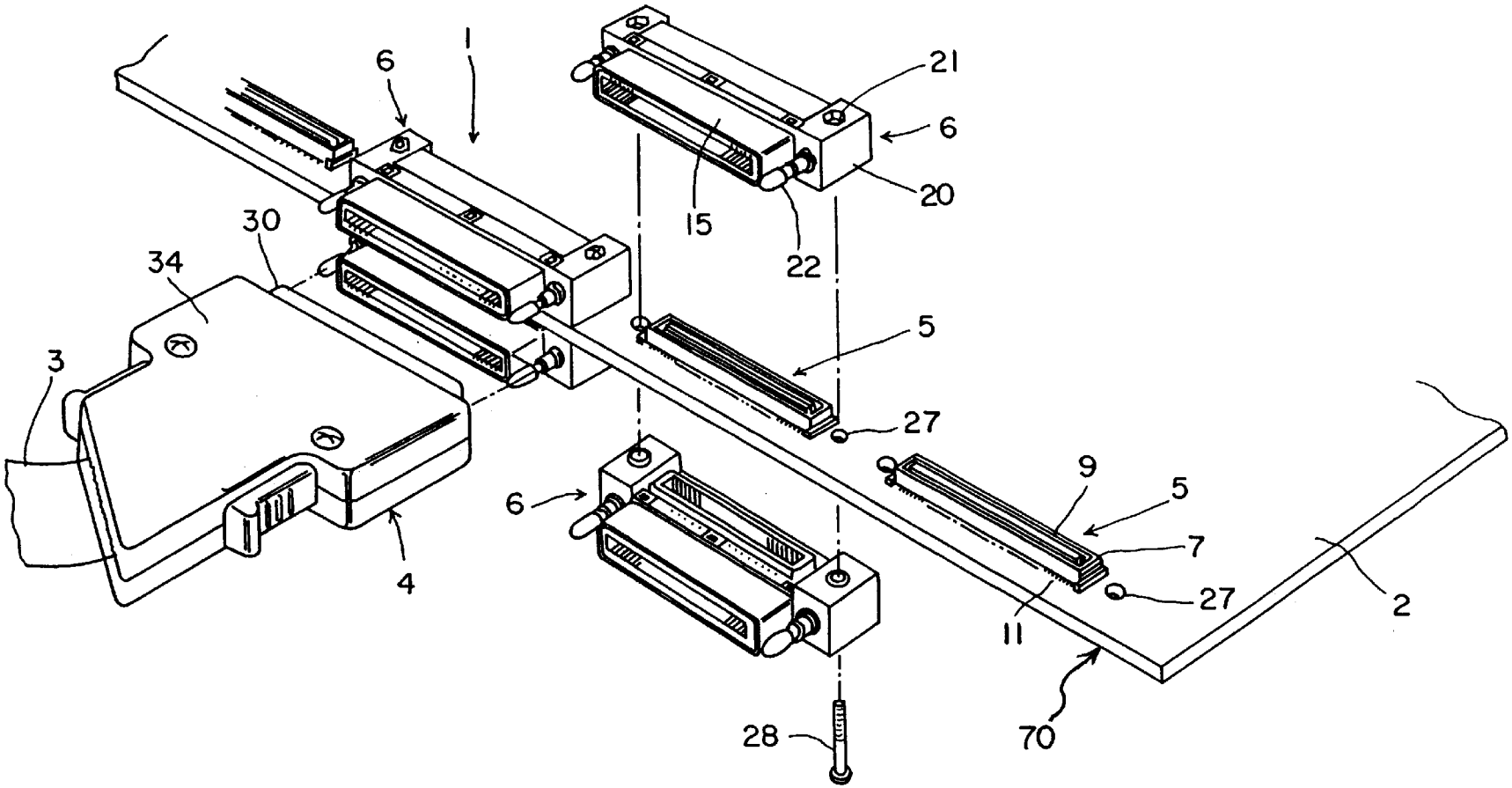
FIG. 1 is an exploded perspective view of a surface mount connector assembly utilizing a preferred embodiment of a surface mount connector constructed in accordance with the principles of the present invention, and which illustrates the manner of mounting of the surface mount connector on a circuit board and the manner of connection with a right-angle connector for providing an I/O type of connection.

FIG. 1 is a perspective view of a surface mount connector assembly, generally indicated at 1 that includes a preferred embodiment of a surface mount connector 5 constructed in accordance with the principles of the present invention. The surface mount connectors of the present invention are particularly suitable for providing a connection between circuits on a circuit board 2 and a series of wires enclosed in a cable 3 and terminated to a wire connector, such as the I/O style connector 4 illustrated. An intervening right-angle connector 6 is mated to the surface mount connector 5 to provide a connector having a dual row leaf terminal arrangement that is matable with the I/O-type cable connector 4.

Two manners of mounting the surface connector assembly 1 to a printed circuit board 2, and engaging a cable connector 4 connected to one end of a wire cable 3 to the surface connector assembly 1 are illustrated. In one manner, such as that shown in the lower right of FIG. 1, a single surface connector 5 is mounted to the circuit board and hence will only mate with a single right-angle connector 6. In the other manner, as shown in the upper left of FIG. 1, two surface connectors 5 are attached to opposing surfaces of the circuit board 2, and two right-angle connectors 6 are mated thereto. Each right-angle connector 6 is matable with an opposing cable connector 4.

The surface mount connector assembly 1 includes the surface mount connector 5 mounted to a surface of the printed circuit board 2 and an engaging, right-angle connector 6 that engages with the upper portion of the surface connector 5.

Figure 2:
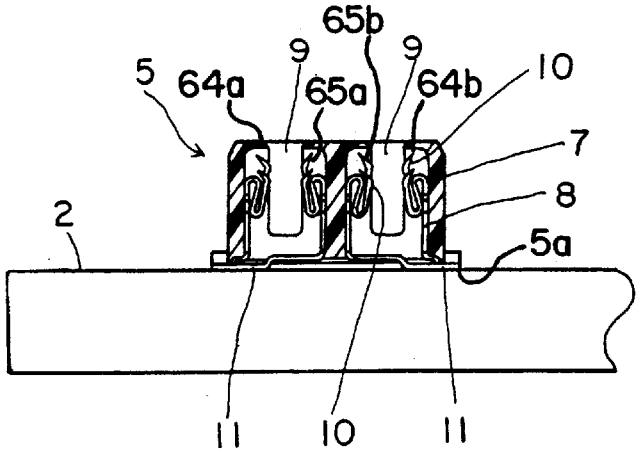
FIG. 2 is cross-sectional view of the surface mount connector illustrated in FIG. 1.
Figure 3:
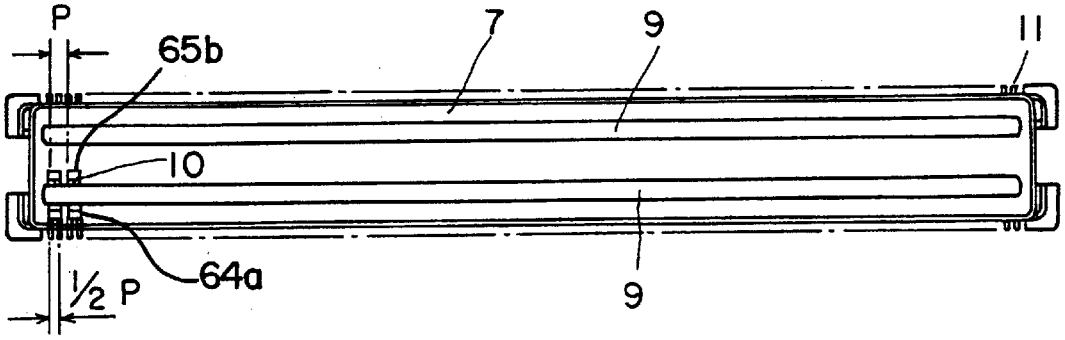
FIG. 3 is a top plan view of the surface mount connector illustrated in FIG. 1.

As shown best in FIGS. 2 & 3, the surface mount connector 5 can be seen to include a connector housing 7 formed from an electrically insulative material and a plurality of conductive terminals 8 that are mounted in the connector housing 7 at a predetermined pitch P. The connector housing 7 is shown as generally rectangular that may include a pair of slots 9 formed therein and opening to the upper surface of the connector housing 7 so as to form a receptacle connector.

Figure 4:
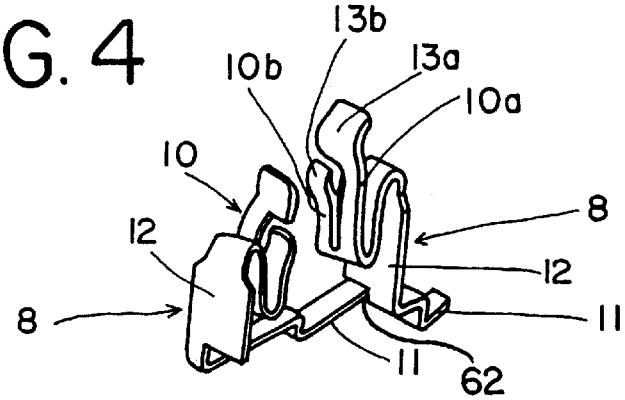
FIG. 4 is a perspective view of a pair of terminals utilized in the surface mount connector of FIGS. 1 and 2 arranged in an opposing pair of terminals.

The terminals 8 are mounted in the connector housing 2 longitudinally in a predetermined pitch P with respective contact portions 10 of the terminals mutually opposing each other on opposite sides of the slots 9. (FIG. 2.) The terminals 8 are arranged in two rows having aligned terminals, as shown in FIG. 4. Two sets of terminals 8 are shown in FIGS. 2 and 3 as mounted in two distinct rows 64*a,* 65*a* and 64*b,* 65*b* in each slot 9. It can be seen that the terminals 8 each have solder tail portions 11 that project along the bottom surface of the connector housing 7 in a manner such that they lie substantially flush with the connector housing bottom surface.

The solder tail portions 11 of the two rows of terminals 8 arranged in one slot 9 project out from one side of the connector housing, while the solder tail portions 11 of the rows of terminals 8 of the other slot 9 project out from the other and opposite side of the connector housing 7. In this relationship, the solder tails 11*a* of the terminals 8*a,* the contact portions 10*a* of which line the first of the two engagement slots 9*a* extend to one side (the right side as seen in FIG. 2) of the connector housing 7, while the solder tails 11*b* of the terminals 8*b* in which the contact pieces 10*b* thereof line the other of the two engagement slots 9*b* extend to the other and opposite side (shown as the left side in FIG. 2) of the connector housing 7.

Turning now to FIG. 4, a pair of opposed terminals of the connector 5 are illustrated in the position they take of two rows in each of the slots 9. Each such terminal can be seen to include a terminal body portion 12, a pair of contact portions 13*a,* 13*b,* and an associated solder tail portion 11. In order to allow the solder tails 11 to be located in the manner set forth above, each of the solder tails 11 of the respective terminals 8 has approximately half width of that of a corresponding opposing terminal body portion 12, such that the solder tails 11 of one row of terminals 8 in one slot 9 extend out of the connector housing 7, but underneath the terminal body portion 12 of the respective terminals 8 of the other row of terminals disposed in the same slot 9, This passing is facilitated by way of a recess, or cavity, 62 formed in the rightmost terminal body portion 12. As a result, it can be seen that the pitch of the solder tails 11 is one-half that of the pitch P of the terminals 8, i.e., ½-P.

The contact portions 10 of the terminals 8 are formed in a characteristic configuration and they each include two divided contact portions 10*a,* 10*b* that preferably extend parallel to each other. One of the divided contact portions 10*a* is longer than the other of the two divided contact portions 10*b,* so that arc-shaped contact portions 13*a,* 13*b* that are provided at the distal ends of the respective divided contact portions 10*a,* 10*b* are aligned along the longitudinal direction of the contact portion 10, i.e, vertically. As seen in FIG. 2, these contact portions 13*a,* 13*b* protrude slightly into the connector housing engagement slots 9.

In assembling the surface mount connector assembly 1, to the edge portion of the printed circuit board 2, the surface mount connector 5 is first mounted to the surface of the circuit board 2, near an edge portion of the circuit board 2 as shown near side of FIG. 1. The solder tail portions 11 of the connector 5 project outwardly from the connector housing 7 along the sides of the connector housing 7 (or what may be considered as forward and rearward when viewing FIG. 1). The solder tail portions 11 are aligned in opposition to conductive pads (not shown) formed on the surface of the circuit board 2. The solder tail portions 11 and the conductive pads are then surface soldered by any desirable manner of soldering, such as by reflow soldering, in order to fix the connector 5 to the circuit board 2. The pitch of the solder tail portions 11 is one-half of the pitch P of the terminal contact portions 10, and thereby reduces the area occupied by the connector 5 and its solder tail portions 11. Thus, a high density connection may be achieved with the circuit board 2 while using a reduced amount of space thereon.

The surface mount connector 5 is of simple construction which basically includes the connector housing 7 and the plurality of conductive terminals 8 set forth above. The solder tails 11 are also formed in a simple exterior configuration, in that they extend outwardly along the bottom surface of the connector housing 7 exterior of the connector housing 7. This structure prevents the solder tail portions 11 from being extremely longer, and facilitates the manufacturing of the solder tail portions 11 of the terminals 8. It is also easy to maintain the arrangement pitch of the solder tails 11 in correspondence with a predetermined pitch P, and enable the surface soldering of the solder tail portions 11 to the circuit board 2 by a normal soldering reflow method.

Furthermore, the solder tail portions 11 project on two opposing sides of the connector housing 7, so that the solder tail portions 11 and the circuit board contact pads of the circuit board lie exposed exterior of the connector housing 7. By this, it is possible to smoothly and certainly perform any inspection of the installation of the connectors 5 to the circuit board by way of video inspection or other methods, without the connector housing 7 acting as an obstruction to obstruct the view of the inspector.

Figure 5:
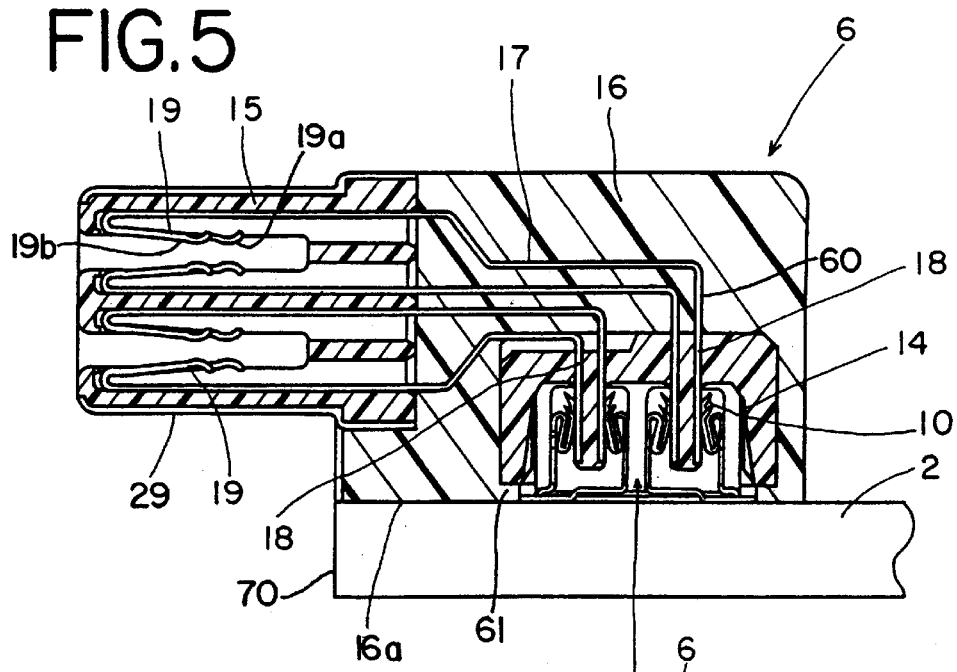
FIG. 5 is a cross-sectional view of the surface mount connector of FIG. 1 mated with an opposing right-angle connector.
Figure 6:
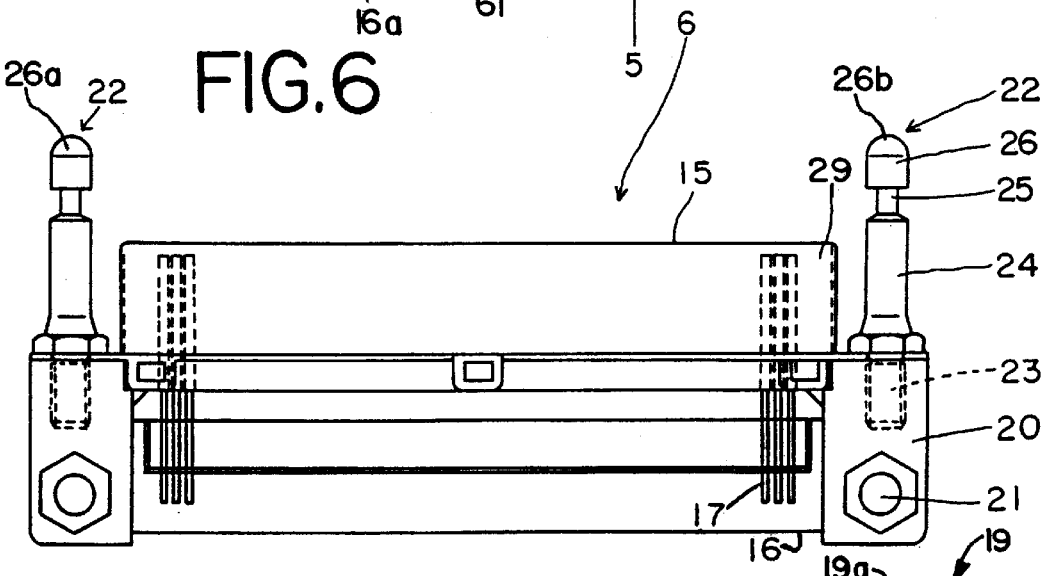
FIG. 6 is a top view of the opposing right-angle connector of FIG. 5.

The right-angle connector 6 is provided as part of the overall surface mount assembly 1 in order to provide an intervening connection, or an intermediate connector between the surface mount connector 5 and a counterpart cable connector that encloses a plurality of terminated wires, such as is the case with input/output ("I/O") style connectors. This right-angle, intermediate connector 6 engages on the upper portion of the surface mount connector 5 and includes a pair of plug portions 60 that are disposed within a housing engagement portion 14 that has an interior cavity 61 that is dimensioned to receive substantially the entire connector housing 7 of the surface mount connector 5 therewithin so that a bottom surface 5*a* of the housing body 16 of the intermediate connector 6 will substantially abut the circuit board 2 as shown in FIGS. 5 and 6. The housing body 16 of the intermediate connector 6 not only encompasses the engagement portion 14, but also extends to one side thereof as shown in FIG. 5 where it receives a dual row leaf receptacle portion 15 as its second engagement portion that will engage the cable connector 4. This leaf portion 15 receives and supports the contact portions 19 of a plurality of conductive terminals 17 and provides surfaces for the support and arrangement of the terminals 17 in two distinct sets of terminals, wherein each set has two opposing rows of terminals 19.

Figure 7:
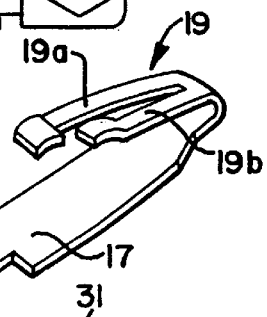
FIG. 7 is a perspective view of a portion of a terminal contact portion of a terminal utilized in the right-angle connector of FIG. 5.

The terminals 17 of the intermediate connector 6 are mounted with the same arrangement pitch P as the contact portions 10 of the surface mount connector terminals 8, and form likewise two sets of terminals corresponding to the two rows of terminals 8 in the two engagement slots 9 of the surface mount connector 5. Contact portions 18 are provided at ends of the terminals 17 which extend a sufficient distance to project into the first engagement portion 14 and the cavity 61 located along the bottom surface 16*a* of the connector housing body 16. In this regard, the contact portions 18 project into respective engagement slots 9 of the surface mount connector 5 and electrically contact and engage opposing contact portions 10 of the connector terminals 8. Second contact portions 19 are provided at the other end of the intermediate connector terminals 17 and are is formed into their specific configuration by turning them back upon themselves within the engagement portion 15 as shown in FIGS. 5 & 7. These contact portions are provided so as to oppose each other in pairs near the engagement end 15 of the intermediate connector 6.

The housing body 16 of the intermediate connector 6 includes end blocks 20 provided at the opposite ends thereof as shown in FIGS. 1 and 6 and provide a means for mounting the intermediate connectors 6 to the circuit board 2. These end blocks 20 each include, as shown, screw holes 21 passing therethrough in a vertical direction. Each end block has a connector guide pin 22 that faces to the front of the connector housing 16. These guide pins are positioned on opposite sides of the connector housing 16 and are provided for guiding the engagement of the opposing cable connector 4 into engagement with the intermediate connector 6. The guide pins 22 may include, as shown.in FIG. 6, a round shaft 24 integrally connected to the distal plug end 26 of the shaft 24 by way of a thin neck portion 25. The plug ends 26 may differ in size, with one plug end 26*b* being larger than the other plug end 26*a* to provide a polarizing feature to ensure proper orientation of the cable connector 4 with the intermediate connector 16 and the plug ends may differ in their axial extent, with one being longer than the other.

The right-angle connector 6 is fixed on the circuit board 2 by first engaging it with the upper portion of the surface mount connector 5 in order to complete the surface mount connector assembly 1. One manner of fixing these intermediate connectors 6 to the surface mount connectors 5 and the circuit board is shown in the middle of FIG. 1. The intermediate connectors 6 are engaged with two corresponding surface mount connectors 5 in a manner such that the whole connector housings 7 of the connectors 5 are received within the first engagement portion 14 of the intermediate connector housing 16. In this manner, the soldering portions of the solder tail portions 11 are also enclosed by the cavity 61 of the first engagement portion 14, such that both the surface mount connector housing 7 and the ends (i.e., the soldering portions) of the solder tail portions 11 are covered by the connector housing 16 to avoid exposing them to the exterior environment.

This engagement of the intermediate connector 6 causes the contact portions 18 at one end of their associated terminals 17 to respectively engage with the opposing contact portions 10 of the surface mount connector terminals 8. Upon engaging, one contact portion 13*a* of the two contact portions 13*a*, 13*b* provided on the contact piece 10 of the surface mount connector 5 wipes the surface of the intermediate connector contact portion 18 and thereby to remove stains or other types of surface contaminants. Therefore, the terminal structure incorporates a self-cleaning function by which it is possible to secure a good electrical engagement.

Furthermore, the pitch of the contact portions 10 and the pitch of the contact portions 18 are twice the pitch of the solder tail portions 11 of the surface mount connector 5, so that the interval between adjacent contact portions 10, 18 is relatively wide. Therefore, this terminal structure avoids the possibility of shorting adjacent terminals in the connectors.

The intermediate connectors 6 that are engaged with the surface mount connector 5 may be directly fixed on the circuit board 2 by way of screws 28 passing through the screw hole 21 of the end blocks 20 formed at the opposite ends of the connector housing 16 and an opening 27 formed in the printed circuit board 2. By directly fixing the intermediate connector 6 to the circuit board 2, any exterior forces that are applied to the intermediate connector 6 as a result of engaging the cable connector 4 therewith, are directly transferred to the circuit board 2 without being transferred to the surface connector 5. This structure avoids imposing forces on the soldering ends of the solder tail portions 11 of the surface connector 5.

When the intermediate connector 6 is engaged with the surface connector 5, the dual row leaf engagement portion 15 that is formed along the upper portion of the intermediate connector 6 projects from the housing 16 thereof and lies along a plane generally parallel to and beyond the edge of the circuit board 2, along with guide pins 22. Therefore, the cable connector 4 may be mounted without being interfered by the edge of the circuit board 2 and so facilitate the installation operation.

Upon engaging the cable connector 4 to the intermediate connector 6, the force applied to the intermediate connector 6 from the connector 4 can be directly transferred to one side of the circuit board 2 as set forth above, so that the force applied is not applied to the surface mount connector 5 in order to protect the soldering portions of the solder tail portions 11. By engaging the right-angle connector 6 with the surface connector 5 so that the contact portions 18 of the terminals 17 of the relay connector 6 are interengaged with each other in a one-to-one relationship, the conductive pads (not shown) of the circuit board 2 are placed within the engagement portion 15 of the right-angle connector 6 in the electrically conducting condition.

The cable connector 4 is thus engaged with the engagement portion 15 to thereby effect a connection between the wires of the cable 3 and the conductive pads (and circuits) of the circuit board 2. The contact portions 19 of the intermediate connector terminals are located within the engaging portion 15. These terminals also include pairs of divided contact portions 19*a,* 19*b* as shown best in FIG. 7 that have short and long lengths that are aligned in a horizontal plane. The divided contact portions 19*a,* 19*b* assist in the cleaning of the opposing contact portions of the cable connector 4, in the manner discussed above with respect to the surface mount connector terminals 8. It should be noted that a metal shell 29 may be fitted onto and around the engagement portion 15 of the connector 16 and is adapted for contacting an opposing metal shell 31 of a counter-engaging portion 30 of the cable connector 4.

Figure 8:
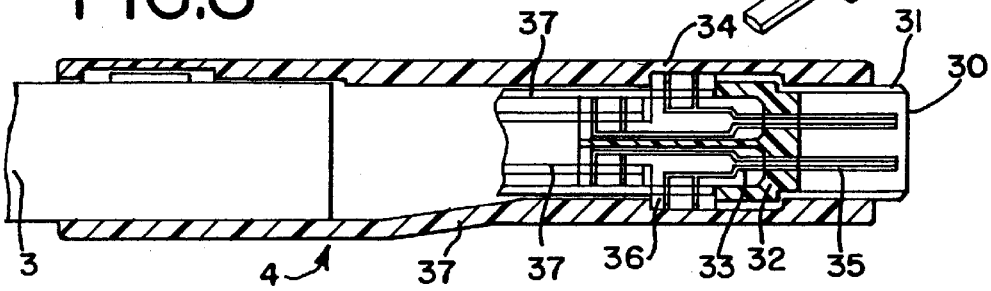
FIG. 8 is a longitudinal cross-sectional view of an exterior connector used in the connector assembly of FIG. 1 that is intended to be connected to the horizontal connection portion of the right-angle connector of FIG. 5.
Figure 9:
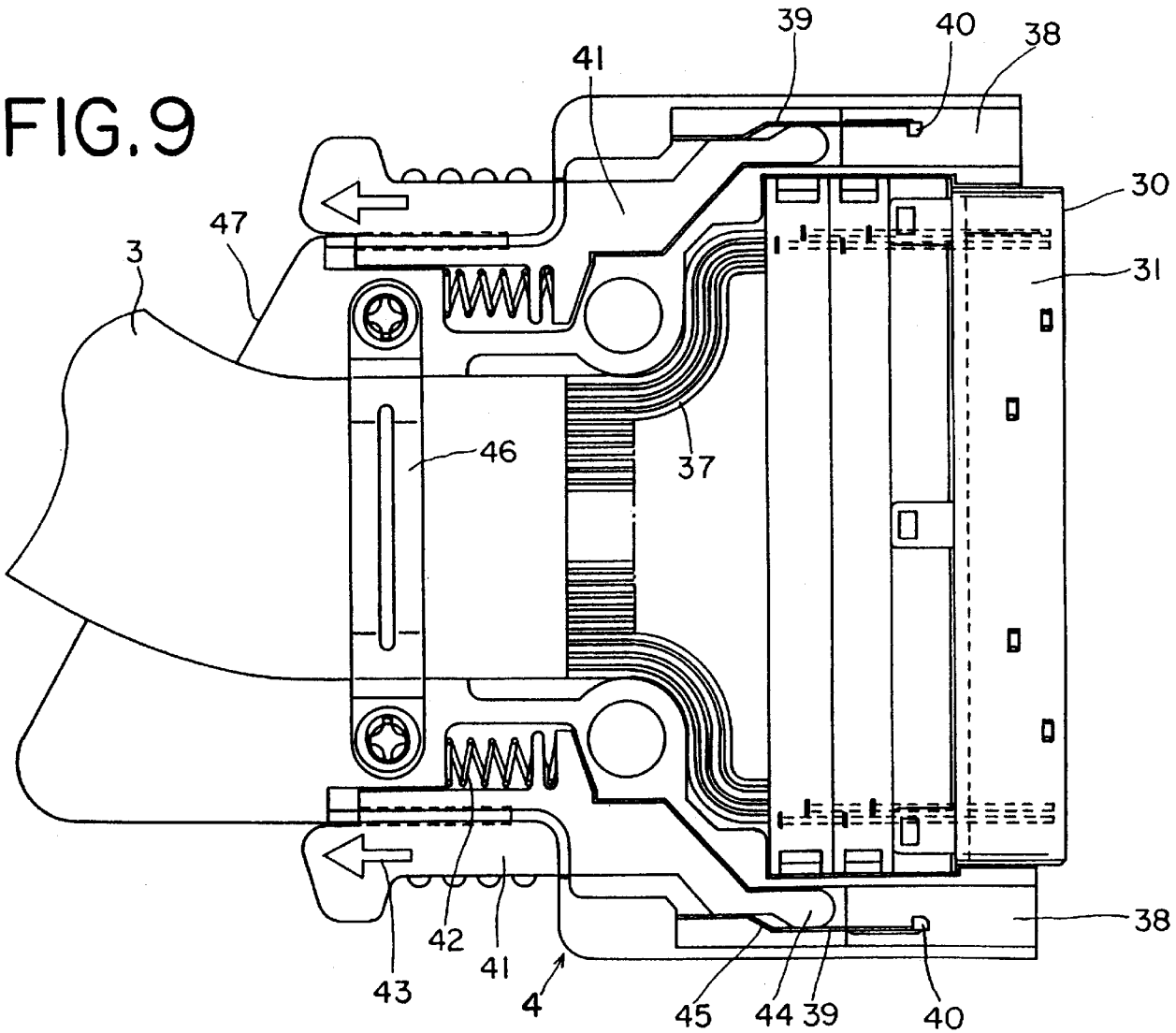
FIG. 9 is a top plan view, partly in section, of the exterior connector of FIG. 8, with a portion of an upper cover portion removed for clarity; and, FIG. 10 is a diagrammatic, top plan view illustrating a plurality of surface mount connector assemblies connected together to corresponding right-angle connectors and aligned with exterior cable connectors.

As shown in FIGS. 8 & 9, the cable connector 4 is constructed to interengage with the intermediate connector engagement portion 15. The cable connector 4 includes a connector housing 32 loaded with a plurality of terminals 33. The connector housing 32 is covered by a metal shielding cover 34 on the outer upper and lower sides thereof. The connector housing 32 includes an engagement portion 30 formed one end thereof that projects outwardly from the metal cover 34. The metal shell 31 is fitted on the periphery of the engaging portion 30 and projects exterior thereof.

The terminals 33 of the cable connector 4 are loaded in a parallel arrangement in the connector housing 32 with the same pitch as the pitch P, that of the terminals 8 in the surface mount connector 5. As shown in FIG. 8, the terminals 33 include contact portions 35 located on the upper and lower sides of the engagement portions 30 and respectively engage with two sets of the contact portions 19 of the intermediate connector 6 that are located within the engagement portion 15. Insulation displacement contact portions 36 are formed on the terminals 33 and are located within the connector housing 32. As is known in the art, insulated wires 37 of the cable 3 that lie within the metal cover 34 are terminated to the terminals 33 in a conventional manner by pressing them against the terminals 33.

As shown in FIG. 9, guide holes 38 are provided on the opposite sides of the cable connector metal cover 34 and receive the guide pins 22 that project from the connector housing 16 of the intermediate connector 6. Engagement hooks 40 are located within the guide holes 38 and are formed at the distal end of latch members 39. When the cable connector 4 is engaged with the intermediate connector 6, the engagement portion 30 is guided by the guide pins 22 and the guide holes 38 so as to oppose the second engagement portions 15 of the intermediate connectors 6. Upon completing the engagement, the hooks 40 engage the guide pins neck portions 25 to thereby engage the head portions 26 thereof and maintain the connectors 4, 16 in engagement.

The latch members 39 are resilient and flex in their lateral directions. Release levers 41 are located along the latch members 39 and are actuated to force the latch members 39 to flex outwardly to release the engagement of the cable connector 4 with the intermediate connector 16. The release levers 41 are located along the side wall of the metal cover 34 and slide parallel to the engaging direction of the connector 4. The release levers 41 are biased toward the engagement portion 30 by coil springs 42, and are manually slid in the direction of the arrow 43 against the force of the coil springs 42.

By engaging the cable connector 4 with the intermediate connector 6, the contact portions 19 of the intermediate connector terminals 17 and the contact portions 35 of the cable connector terminals are engaged together. The latter terminals receive the cleaning action of the contact portions 19 and thereby connect the individual wires 37 of the cable 3 to appropriate corresponding circuits on the circuit board 2. Upon releasing the cable connector 4 from its engagement with the intermediate connector 6, the release levers 41 are slid rearwardly in the direction of arrow 43. Actuating portions 44 at the distal end of the release levers 41 lie along the bent portions 45 formed on the bases of the latch members 39. When the release levers 41 are slid backwards as shown, the actuating portions 44 engage the bent portions 45 and flex the latch members 39 outwardly to release the engagement of the hooks 40 with the guide pins 22, thereby completing the disengagement.

Figure 10:
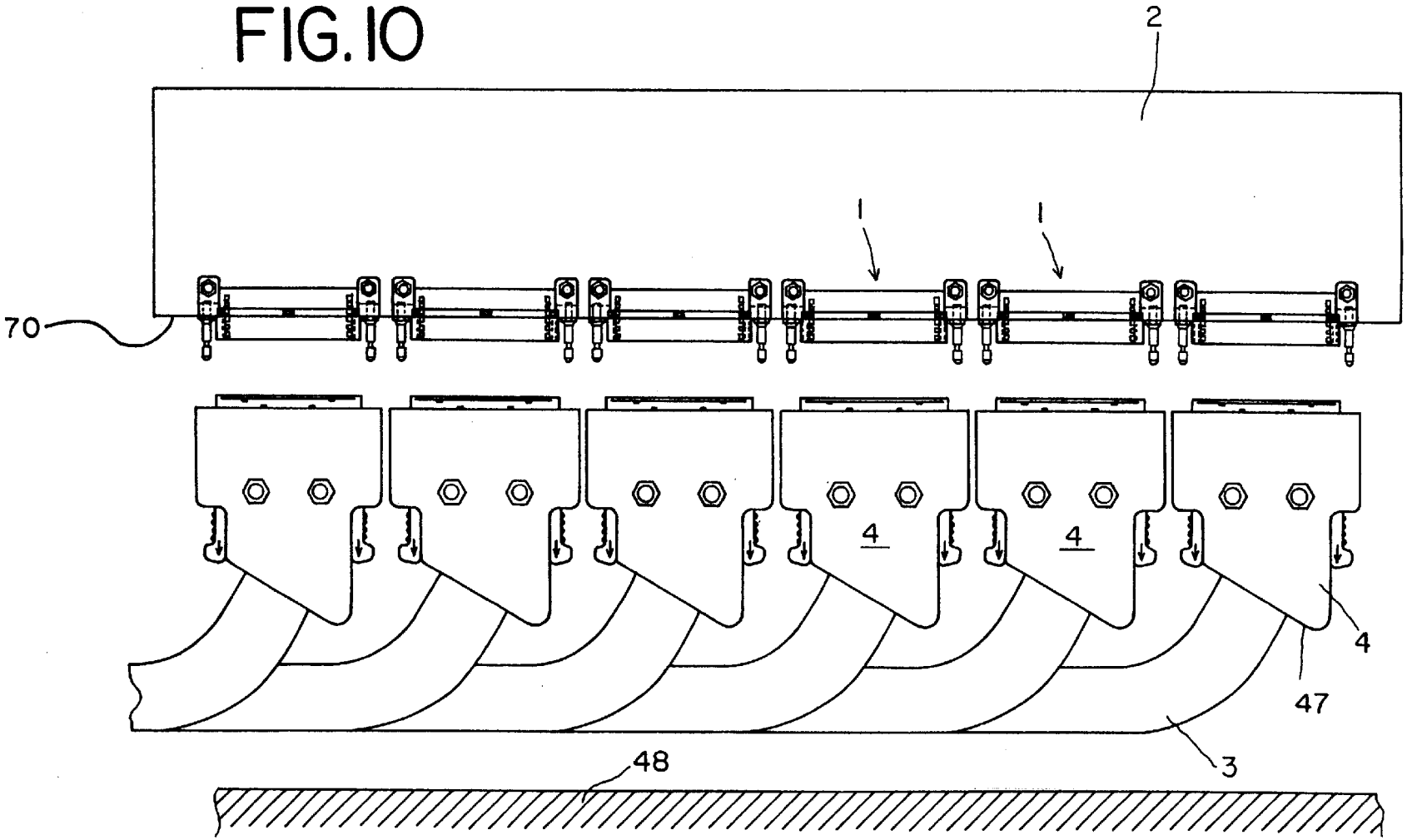

The cable wire 3 may be fixed to one of the metal covers 34 via a clamp bar 46 as shown in FIG. 9. A tapered edge 47 is provided at the end of the housing and is provided to facilitate extending the cable 3 obliquely in the direction of the tapered edge 47. As shown in FIG. 10, the tapered edge 47 is provided in consideration of the case that a plurality of the surface mount connector assemblies 1 are mounted to the circuit board 2, and the space on the outside of the edge of the circuit board 2 is narrow and restricted by a wall or door 48 that serves as part of an overall casing that receives the circuit board 2, such as a housing for a portable computer. In this case, a plurality of the cables 3 respectively extend along the doors or wall 48 in the lateral direction thereof. Therefore, the cable 3 outwardly extending from the cable connector 4 facilitates bending in a direction perpendicular to the tapered edges 47 of the connector housing 32 to avoid applying the excessive force to the insulation displacement terminals 37 and the connector clamp bar 46.

FIG. 1 illustrates the surface mount connectors 5 mounted on opposite surfaces of the circuit board 2, and with intermediate connectors 6 engaged with the surface mount connectors 5. The intermediate connectors 6 provided on the opposite surfaces of the surface mount connector 5 are fixed on the circuit board 2 by common screws 28. By mounting two such connector assemblies 1 on the opposite surfaces of the circuit board 2, the effective utilization of the opposite surfaces of the circuit board 2 is accomplished. It will be understood that the surface connector 5 may be mounted to only one surface of the circuit board 2 and engaged with one corresponding intermediate connector 6.

The fixing of the intermediate connectors 6 on the circuit board 2 is also not limited to means of mounting screws 28. It is possible to use other fixing means, such as a fixing peg provided on the intermediate connector housing body 16. With the use of screws 28, it is easy to fix and releasably mount the intermediate connector 6 from the surface mount connector 5, which is convenient for replacement and repair. The screws 28 used in FIG. 1 may engage formed openings in the opposite intermediate connector 6 so that two such intermediate connectors 6 mounted on the opposite surfaces of the circuit board may be simultaneously fixed by one common screw 28.

The preferred embodiment in which the connector housing 7 is provided with two rows of engaging slots 9. However, it will be understood that the present invention also contemplates the use of only one engagement slot 9 formed in the surface mount connector housing 7.

As set forth above, according to the present invention, because the pitch of the contact portions arranged in the engaging slot of the surface mount connector can be made relatively wider, shorting between adjacent contact portions will be successfully prevented. Also, because the pitch of the solder tail portions can be made relatively small, high density connection on the circuit board is possible.

While the preferred embodiments of the invention have been shown and described, it will be understood by those skilled in the art the changes or modifications may be made thereto without departing from the true spirit and scope of the invention.

What is claimed:

1. A surface mount connector for providing an electrical connection between an opposing connector and circuits on a printed circuit board, the connector comprising;

an elongated connector housing formed from an electrically insulative material, the connector housing having a body portion with distinct first and second sides and further having distinct first and second receptacles formed therein and extending lengthwise of said connector housing, the first and second receptacles receiving respective first portions of the opposing connector when said surface mount connector and said opposing connector are engaged together;

a plurality of electrically conductive terminals disposed in said connector housing and within said first and second receptacles, each of said terminals having two ends, one of said terminal two ends including a solder tail portion that extends horizontally and outwardly of said connector housing near a bottom surface of said connector housing for soldering to an opposing surface of said circuit board and the other of said terminal two ends including a vertical contact portion for contacting an opposing terminal of said opposing connector when said surface mount connector and said opposing connector are engaged together, said terminal solder tail and contact portions being connected by a vertical intervening body portion;

some of the terminals being arranged in distinct first and second rows on opposite sides of said first and second receptacles, and the remaining terminals being arranged in distinct third and fourth rows on opposite sides of said second receptacle, said terminal contact portions being arranged in each of said distinct first, second, third and fourth rows in a first predetermined pitch and said terminal solder tail portions of said first, second, third and fourth terminal rows being arranged in a second predetermined pitch that is one-half of said first predetermined pitch, said terminal solder tail portions of said first and second terminal rows extending horizontally out from said connector housing along the first side of said connector housing and said terminal solder tail portions of said third and fourth terminal rows extending horizontally out from said connector housing along the second side of said connector housing; and, wherein said second row terminal solder tail portions pass across and under said first row terminal vertical body portions as they extend horizontally outwardly from said connector housing, and wherein said fourth row terminal solder tail portions pass across and under said third row terminal vertical body portions as they extend horizontally outwardly from said connector housing.

2. The surface mount connector of claim 1, wherein only said first row and third row terminal body portions include recesses respectively formed therein and said second row terminal solder tail portions extend through said recesses in said first row terminal body portions and under said first row terminal body portions to extend outwardly from said connector housing, and said fourth row terminal solder tail portions extend through said recesses in said third row terminal body portions and under said third row terminal body portions to extend outwardly from said connector housing.

3. The surface mount connector of claim 1, wherein each terminal contact portion is bifurcated and includes first and second distinct contact heads aligned with each other and spaced apart from each other.

4. The surface mount connector of claim 3, wherein said first and second contact heads are arranged at different elevations on said terminal contact portions.

5. The surface mount connector of claim 1, wherein said first and second receptacles include respective first and second slots formed in said connector housing and wherein said terminal solder tail portions of said first, second, third and fourth terminal rows have widths that are no greater than one-half of their respective terminal body portions.

6. The surface mount connector of claim 5, wherein said connector housing first and second slots lie on opposite sides of said connector housing.

7. A surface mount connector for providing an electrical connection between an opposing connector and a plurality of circuits on a circuit board, the circuit board circuits having conductive pads formed on a first surface of said circuit board, comprising:

a connector housing formed from an electrically insulative material and having a body portion extending between two ends of said housing, the connector housing having two opposing sidewalls extending along said body portion, the connector housing having first and second receptacles formed therein between the connector housing sidewalls, the receptacles extending lengthwise within said connector housing body portion and being adapted to receive respective engagement portions of the opposing connector;

a plurality of conductive terminals disposed in said connector housing and arranged in side-by-side order lengthwise within said first and second receptacles, said terminals further being arranged in first and second distinct rows within said first receptacle and on opposite sides thereof and arranged in third and fourth distinct rows within said second receptacle and on opposite sides thereof;

each of said terminals having a vertical body portion disposed within said connector housing, a horizontal solder tail portion disposed at one end of said terminal vertical body portion and extending away therefrom at an angle for attaching to a circuit board conductive pad, the horizontal solder tail portions of said terminals further extending out of said connector housing proximate to a bottom portion thereof, and a vertical contact portion disposed at another end of said vertical terminal body portion for contacting an opposing terminal of said opposing connector;

said horizontal solder tail portions of said first and second rows of terminals extending in the same direction away from their respective body portions, said horizontal solder tail portions of said second row terminals being aligned with and passing beneath said first row terminal vertical body portions through recesses formed in said first row terminal vertical body portions such that said horizontal solder tail portions of said first and second row terminals extend out from said housing along one of said sidewalls of said connector housing, and said horizontal solder tail portions of said third and fourth rows of terminals extending in the same direction away from their respective vertical body portions, said horizontal solder tail portions of said fourth row terminals being aligned with and passing beneath said third row terminal vertical body portions through recesses formed in said third row terminal vertical body portions such that said horizontal solder tail portions of said third and fourth row terminals extend out from said connector housing along the other of said sidewalls of said connector housing.

* * * * *